US006135096A

United States Patent [19]

Bolz et al.

[11] Patent Number: 6,135,096

[45] Date of Patent: Oct. 24, 2000

[54] CONTROL DEVICE FOR A FUEL INJECTION SYSTEM

[75] Inventors: Stephan Bolz, Goerisried; Herbert Lacher, Feldkirchen, both of Germany

[73] Assignee: Siemens Aktiengesellschaft, Munich, Germany

[21] Appl. No.: 09/287,813

[22] Filed: Apr. 7, 1999

[30] Foreign Application Priority Data

Apr. 7, 1998 [DE] Germany ..... 198 15 628

[51] Int. Cl.[7] ..... F02M 51/00

[52] U.S. Cl. ..... 123/490; 361/152

[58] Field of Search ..... 123/490, 478; 361/152–156

[56] References Cited

U.S. PATENT DOCUMENTS

| | | | |
|---|---|---|---|
| Re. 31,391 | 9/1983 | Davis et al. | 361/154 |
| 4,473,861 | 9/1984 | Kosak et al. | 361/152 |
| 4,665,459 | 5/1987 | Bynum et al. | 123/490 |
| 5,285,345 | 2/1994 | Blumel et al. | 123/490 |
| 5,430,601 | 7/1995 | Burcham | 361/154 |
| 5,469,825 | 11/1995 | Golab et al. | 123/490 |
| 5,731,946 | 3/1998 | Kahr | 361/154 |
| 5,936,827 | 8/1999 | Dressler et al. | 361/154 |
| 5,992,391 | 11/1999 | Yamakado et al. | 123/490 |

*Primary Examiner*—Erick Solis
*Attorney, Agent, or Firm*—Herbert L. Lerner; Laurence A. Greenberg; Werner H. Stemer

[57] ABSTRACT

The control device drives a power output stage, in particular of a fuel pump or a fuel injection valve. The control device has a series circuit with a highside switch, a first resistor and a first capacitor. A second capacitor is connected between a lowside switch and the highside switch. A further series circuit includes the first resistor, a second resistor and a second capacitor and is connected in parallel with the second capacitor. A further resistor is connected between the supply voltage terminal and the lowside switch.

4 Claims, 1 Drawing Sheet

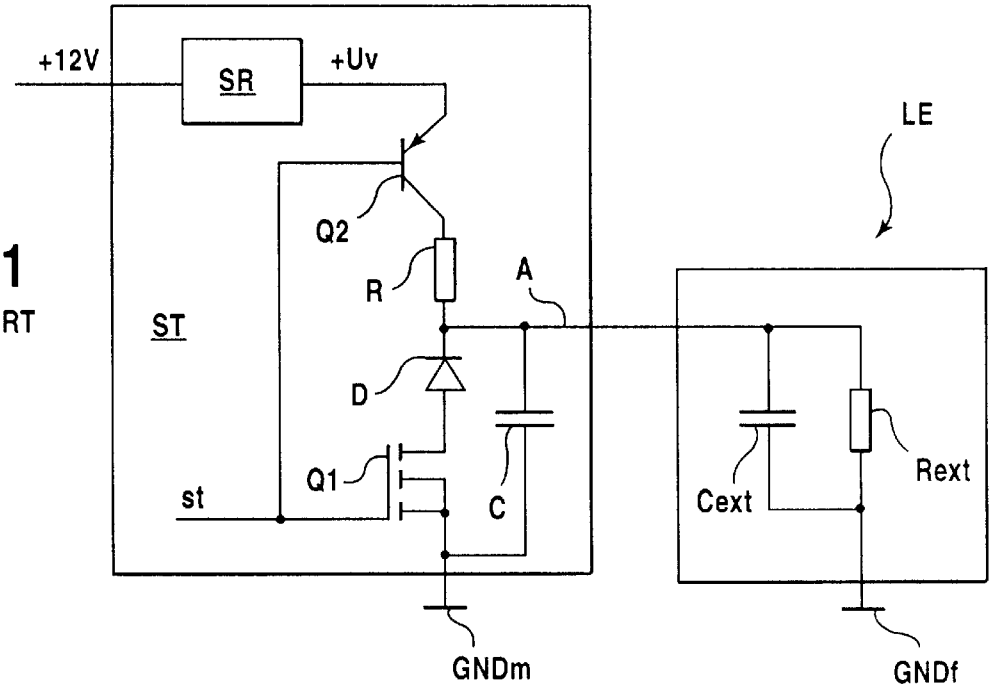
FIG.1
PRIOR ART
FIG.2
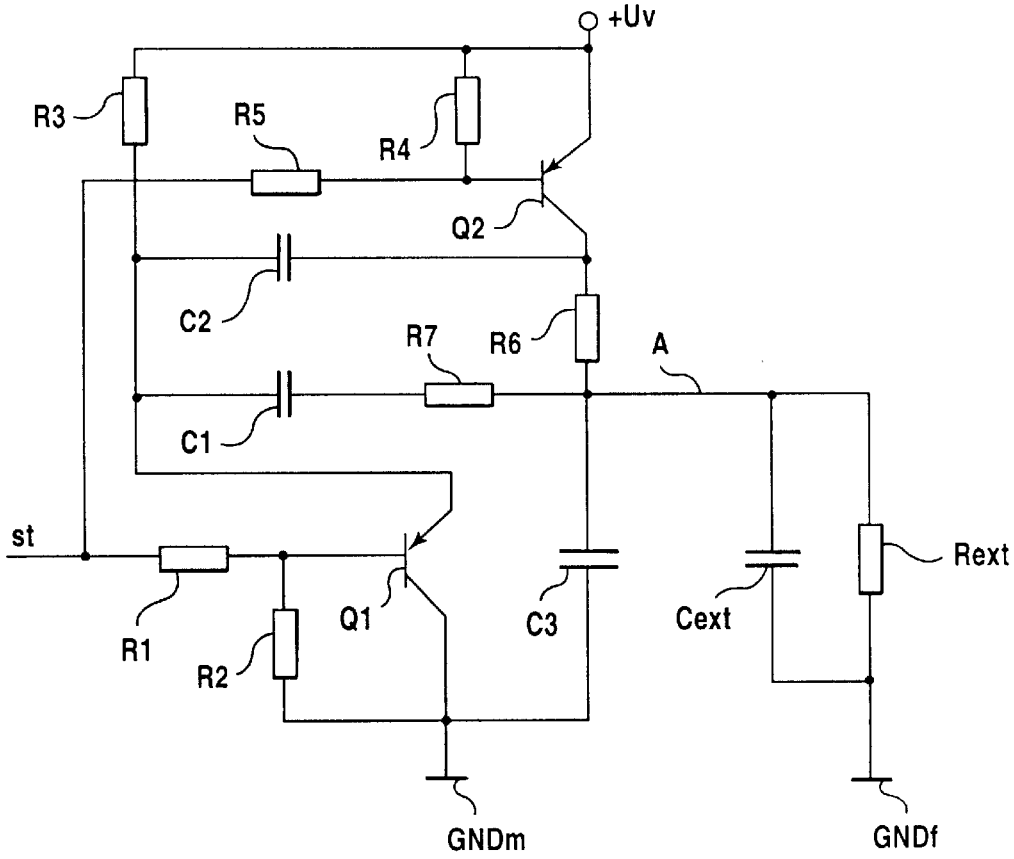

CONTROL DEVICE FOR A FUEL INJECTION SYSTEM

BACKGROUND OF THE INVENTION

Field of the Invention

The invention lies in the automotive arts. Specifically, the invention relates to a control device for a fuel injection system, in particular for driving the power output stage of a fuel pump or of a fuel injection valve of an internal combustion engine.

Switching signals for an external electronic power system, by means of which a power output stage and thus, for example, a (diesel) fuel pump or fuel injection valves are activated, are output at the output side of a control device. In order to control the quantity of fuel precisely, the time characteristics of the switching signals must be precise and stable, even if the input impedance of the electronic power system can fluctuate within wide ranges for fabrication reasons. The trailing switching signal edge is functionally of particular importance here.

The following requirements are made of such a control device: signal level Low <0.9V; High >3.3V;

Voltage switching edge 3 $\mu$s with max. tolerance of ±1.5 $\mu$s;

Temperature range: −40° C. . . . +125° C.;

Input impedance of the electronic power system:

10 kΩ<Rin <1MΩ, 1nF <Cin <3nF (a further 1nF capacitor —C3 — is also present in the engine control unit for the sake of EMV suppression);

Protection of the output against short-circuiting to ground;

Minimum leakage currents when the ground potential at the control unit is lost ("loss of ground").

In addition to the short-circuit withstand capability which is necessary in the field of motor vehicles, in the case of "loss of ground" the electronic power system must not switch on under any circumstances; it would result in a static high level at the input of the electronic power system and thus in an uncontrolled supply of fuel, which could lead to damage to the engine and to persons.

Previous circuits have used a pnp-type transistor as highside switch with a series resistor between the collector and output and in addition a MOS-FET as lowside switch between the output and ground in order to discharge quickly the EMC capacitance and the input capacitance of the electronic power system connected downstream. This serves to generate a trailing switching signal edge with the required time characteristics.

Since the drain terminal of the lowside switch is connected directly to the output, overcurrent disconnection must be provided as a protection against short-circuiting to the battery. This is part of a complex switching IC which is used.

The required disconnection in the event of "loss of ground" is brought about by inserting a diode in series with the lowside switch. However, as a result of the additional diode forward voltage, the required low level (<0.9V) can no longer be maintained at low temperatures.

SUMMARY OF THE INVENTION

It is accordingly an object of the invention to provide a control device for a fuel injection system, which overcomes the above-mentioned disadvantages of the heretofore-known devices and methods of this general type and which satisfies the above requirements even at low temperatures.

With the foregoing and other objects in view there is provided, in accordance with the invention, a control device for a power output stage, in particular for driving the power end stage of a fuel pump or a fuel injection valve, comprising:

a supply voltage source and series circuit connected between the poles of the supply voltage source, the series circuit including a bipolar pnp-type transistor highside switch, a first resistor, and a first capacitor;

an output connected between the first resistor and the first capacitor;

a lowside switch connected in series with the highside switch between the poles of the supply voltage source;

a second capacitor connected between the highside switch and the lowside switch;

a second series circuit connected in parallel with the second capacitor and including the first resistor, a second resistor, and a third capacitor; and a further resistor connected between the supply voltage terminal and the lowside switch.

In accordance with a concomitant feature of the invention, the lowside switch is an npn-type transistor.

Other features which are considered as characteristic for the invention are set forth in the appended claims.

Although the invention is illustrated and described herein as embodied in control device for a fuel injection system, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

BRIEF DESCRIPTION OF THE DRAWINGS

FIG. 1 is a circuit schematic of a prior art control device; and

FIG. 2 is a circuit schematic of the invention for a control device for a fuel injection system.

DESCRIPTION OF THE PREFERRED EMBODIMENTS

Referring now to the figures of the drawing in detail and first, particularly, to FIG. 1 thereof, there is seen a prior art control device for a fuel injection system of an internal combustion engine for a motor vehicle. The control device is disposed in an engine control unit ST indicated as a box, and has already essentially been described above. Between the output of a 5V voltage regulator SR, fed by a 12V motor vehicle battery, and a ground terminal GNDm of the engine control unit ST there is a pnp-type highside switch Q2 in a series circuit comprising a resistor R, a diode D and a MOS-FET lowside switch Q1. An EMV capacitor C is connected in parallel with the diode D and the lowside switch Q1.

An output terminal A is tapped at the node between the resistor R and the EMV capacitor. The output A of the control device ST is connected to the input of the following power output stage LE (indicated as a box) of a fuel injection system. The input impedance of the power output stage LE is indicated as a parallel circuit comprising a resistor Rext and a capacitor Cext between the output A and the vehicle ground GNDf.

The lowside switch Q1 and the highside switch Q2 are supplied synchronously with a drive signal st. The output A is thus virtually at ground potential (0V) when the control signal st is at a high level, and virtually at the potential of the supply voltage +Uv when the signal is at a low level.

Referring now to FIG. 2, the circuit of the invention has the series circuit (known from FIG. 1) formed of a pnp-type highside switch Q2, a resistor R6 and a capacitor C3 between the terminal of the supply voltage +Uv and the ground terminal GNDm. The output A is located at the connection point between the resistor R6and the capacitor C3. The output A is connected, as in FIG. 1, to the input of the following power output stage LE of the fuel injection system. The input impedance of the power output stage LE is indicated once more as a parallel circuit comprising a resistor Rext and a Cext capacitor between the output A and the vehicle ground GNDf. The lowside switch Q1, implemented as an npn-type transistor, and the pnp-type highside switch Q2 are each provided with a base-emitter resistor R2 and R4, respectively, and a base resistor R1 and R5, respectively. The control signal st is fed synchronously to the two switches Q1 and Q2 via these base resistors R1 and R5, respectively.

A capacitor C2, in parallel with which a series circuit comprising the resistor R6, a further resistor R7 and a further capacitor C1 is connected, is arranged between the collector terminals of the highside switch Q2 and lowside switch Q1. An additional resistor R3 is connected between the terminal of the supply voltage +Uv and the collector of the lowside switch Q2.

The circuit operates as follows, with the component dimensioning specified below:

During the positive switching edge of the control signal st, the lowside switch Q1 becomes conductive and the highside switch Q2 becomes nonconductive; the power output stage LE is switched off (negative switching edge-fuel injection is switched off). The static low level is determined by the resistor Rext in the power output stage LE. This ensures a low level <0.9V (referred to vehicle ground potential GNDf).

The dynamic output impedance is determined by the lowside switch Q1, the resistor R7 and the capacitor C1. The lowside switch Q1 only has a low saturation voltage and the impedance of C1 and C2 can be ignored during the switching edge. Thus, the resistor R7 essentially determines the dynamic impedance (approximately 220 Ω with the specified dimensioning). The capacitors C1 and C2, which lose charge in the conductive state of the lowside switch Q1, are then charged up again by means of the resistor R3.

During the negative switching edge of the control signal st, the lowside switch Q1 becomes nonconductive and the highside switch Q2 becomes conductive; the power output stage LE is switched on (positive switching edge—fuel injection is switched on). The static high level is determined by the voltage divider composed of the highside switch Q2 and the resistors R6 and Rext. The resistor R6 is to be dimensioned in such a way that the required value for the highside level (>3.3V) is reliably achieved given a minimum value of Rext (10 kΩ) and a conductive highside switch Q2 (voltage drop <0.2V).

The resistor R6 serves at the same time to limit current in the case of a short circuit and thus protects the highside switch Q2.

The output impedance is determined by the highside switch Q2, the resistors R6 and R7 and the capacitors C1 and C2. The highside switch Q2 only has a low saturation voltage, and the impedance of C1 and C2 can be ignored during the switching edge. The parallel circuit comprising the resistors R6, R7 thus essentially determines the dynamic overall impedance of approximately 200 Ω (220 Ω//2 kΩ) with the specified dimensioning).

The capacitors C1 and C2 are charged weakly during the switching edges, but during the static high level or low level there is a slow discharge via the resistors R6 and R7 so that the initial state is achieved again by the next switching edge.

The internal resistor Rext of the connected power output stage LE is 10 kΩ at minimum; it is high in comparison with the overall impedance of the output A and thus has no influence on the switching times T, which are determined by the overall impedance and the sum of the capacitances C3 and Cext of the capacitors: T=R7*(C3+Cext).

In the event of "loss of ground" of the ground potential GNDm at the control unit ST, the potential at the terminal of the supply voltage +Uv (normally +5V) rises, as does the potential at the ground terminal GNDm and that of the control signal st, to +12V (battery voltage). The emitter potential and base potential of the highside switch Q2 are thus correspondingly +12V, i.e., the highside switch Q2 is nonconductive. The potential at the output A is at vehicle ground potential GNDf—via the resistor Rext.

The lowside switch Q1 is connected to the output A via the capacitor C1 and the resistor R7. The d.c. decoupling avoids the output A being influenced when there is "loss of ground."

In addition, the lowside switch Q1 is protected against short-circuiting.

This results in the following advantages of the control device according to the invention: in the event of a "loss of ground" fault, the power output stage is reliably prevented from switching on; the protective diode for protecting against "loss of ground" is dispensed with; the required low level <0.9V is reliably maintained; the lowside switch Q1 does not require any protection against short-circuiting to the battery voltage; the switching edges are not influenced by the internal resistance of the power output stage which is connected; all the static and dynamic requirements made with the output are fulfilled; the switch can be manufactured cost-effectively with standard components.

In a preferred exemplary embodiment according to the invention, components with, inter alia, the dimensions below are used, taking into account the requirements made of the control device which are defined at the beginning:

| | | | |
|---|---|---|---|
| R3 | 1 kΩ | C3 | 1 nF |
| R6 | 2 kΩ | Rext | 10 kΩ < Rext < 1 MΩ |
| R7 | 220 Ω | Cext | 1 nF < Cext < 3 nF |
| C1 | 100 nF | Q1 | pnp-type transistor |
| C2 | 22 nF | Q2 | npn-type transistor |

We claim:

1. A control device for a power output stage, comprising:

a supply voltage source having two poles;

a series circuit connected between the poles of said supply voltage source and including a bipolar pnp-type transistor highside switch, a first resistor, and a first capacitor;

an output connected between said first resistor and said first capacitor;

a lowside switch;

a second capacitor connected between said highside switch and said lowside switch;

a second series circuit connected in parallel with said second capacitor and including said first resistor, a second resistor, and a third capacitor; and a further resistor connected between the supply voltage terminal and said lowside switch.

2. The control device according to claim 1, wherein said lowside switch is an npn-type transistor.

3. In combination with a fuel pump of an internal combustion engine, the control device according to claim 1 connected to and driving a power output stage of the fuel pump.

4. In combination with a fuel injection valve of an internal combustion engine, the control device according to claim 1 connected to and driving the fuel injection valve.

* * * * *